US005432144A

United States Patent [19]

Komamura et al.

[11] Patent Number: 5,432,144

[45] Date of Patent: Jul. 11, 1995

[54] THERMAL-TRANSFER RECORDING MATERIAL AND A THERMAL-TRANSFER RECORDING PROCESS

[75] Inventors: Tawara Komamura; Noritaka Nakayama; Katsunori Katoh, all of Hachioji; Norio Miura, Sagamihara; Tatsuo Tanaka, Hachioji; Yoriko Nakayama, Hino, all of Japan

[73] Assignee: Konica Corporation, Tokyo, Japan

[21] Appl. No.: 50,670

[22] Filed: Apr. 22, 1993

[30] Foreign Application Priority Data

Apr. 27, 1992 [JP] Japan ..... 4-107778

[51] Int. Cl.[6] ..... B41M 5/035; B41M 5/38

[52] U.S. Cl. ..... 503/227; 428/195; 428/913; 428/914

[58] Field of Search ..... 8/471; 428/195, 913, 428/914, 412, 480, 500, 522; 503/227; 106/23 K

[56] References Cited

FOREIGN PATENT DOCUMENTS 59-78893 5/1984 Japan ..... 503/227
59-109349 6/1984 Japan ..... 428/289
59-109389 6/1984 Japan ..... 428/488.4
60-2393 1/1985 Japan ..... 503/227
3-114892 5/1991 Japan ..... 503/227

*Primary Examiner*—B. Hamilton Hess
*Attorney, Agent, or Firm*—Finnegan, Henderson Farabow, Garrett & Dunner

[57] ABSTRACT

A thermal transfer recordimg material comprising a support having thereon a thermal transfer layer containing a dye represented by the following formula and a thermal transfer recording process capable of recording magenta images by forming a chelate dye in the presence of a metallic ion-containing compound

7 Claims, 1 Drawing Sheet

THERMAL-TRANSFER RECORDING MATERIAL AND A THERMAL-TRANSFER RECORDING PROCESS

FIELD OF THE INVENTION

The present invention relates to a thermal-transfer recording material capable of forming high-density/-high-stability images and also to a thermal-transfer recording process capable of recording magenta images efficiently by using the same material.

BACKGROUND OF THE INVENTION

As means for obtaining color hard copies there have conventionally been studied color image recording techniques based on ink-jet, electrophotographic, thermal-transfer and silver halide photographic processes. Among these, particularly, the thermal-transfer process has the merits that its thermal-transfer recording material can be easily handled and maintained, its equipment can be made smaller in size for cost reduction, and its running cost is inexpensive.

In the thermal-transfer recording process, the dye used therefor plays an important role, but those conventionally used in the process have the disadvantage that the stability of images formed therewith is poor, particularly in the fixability and resistance to light.

In order to solve the above problem, JP O.P.I. Nos. 78893/1984, 109389/1984 and 2398/1985 disclose the use of thermally diffusible dyes capable of chelating (hereinafter called post-chelating dyes) to form a chelate dye image on an image-receiving material. JP O.P.I. No. 114892/1991 discloses a thermal-transfer recording material containing a post-chelating dye for forming a pyridylazo-type magenta dye and an image-forming method which uses the same dye.

The post-chelating dyes disclosed in the above patent publications have such excellent characteristics as the satisfactory color for forming satisfactory magenta color images, high chelating-reactivity, and high sensitizability. However, they have problems in their preservability when used in ink sheets and their aptitude (solubility) for the use in ink-making.

SUMMARY OF THE INVENTION

It is an object of the present invention to provide a thermal transfer recording material containing a post-chelating dye and having excellent ink-making aptitude and good preservability when used in ink sheets.

It is another object of the invention to provide a thermal transfer recording process which uses the above thermal transfer recording material.

The above objects of the invention are accomplished by (1) a thermal transfer recording material comprising a support having thereon at least one thermal transfer layer containing a dye represented by the following Formula 1:

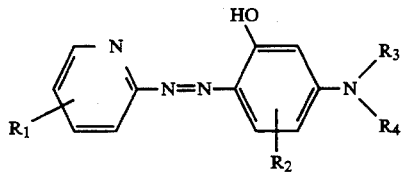

Formula 1 wherein $R_1$ is an alkyl group, a halogen atom or a hydrogen atom; $R_2$ is an alkyl group or a hydrogen atom; $R_3$ and $R_4$ each represent a substituted or unsubstituted alkyl group or a substituted or unsubstituted aryl group, provided at least either one of $R_3$ and $R_4$ is an aryl group substituted with an alkyl group or an alkyl group substituted with an alkyl-substituted aryl group.

(2) a thermal transfer recording process comprising superposing an image-receiving material upon the thermal transfer recording material comprising the support having thereon the thermal transfer layer containing the dye represented by Formula 1, and heating according to imagewise information the thermal transfer recording material to effect the reaction of the dye with a metallic ion-containing compound to thereby form a chelate dye image.

DETAILED DESCRIPTION OF THE INVENTION

Figure 1:
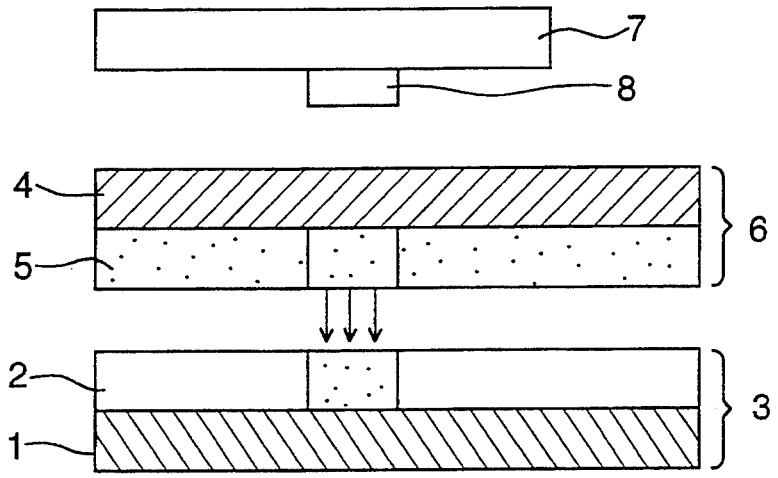
FIGS. 1(*a*) and 1(*b*) are each an explanatory drawing of the thermal transfer recording process of the invention.
Figure 1:
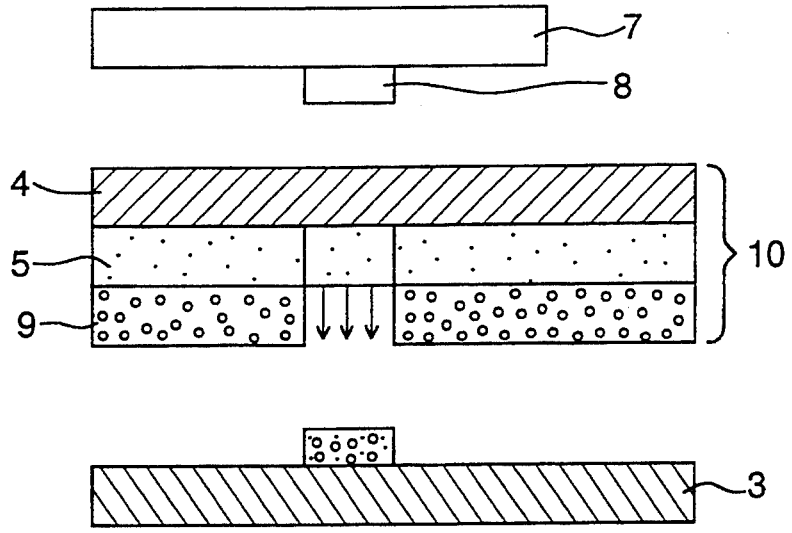

The invention is characterized by the use of a post-chelating dye which, due to its chelation, can provide a satisfactory magenta color, can effect a fast chelating reaction and thus provide a high-density image with a low energy.

In Formula 1, $R_1$ represents an alkyl group (e.g., methyl, ethyl or butyl), a halogen atom (e.g., chlorine or bromine) or a hydrogen atom; $R_2$ represents an alkyl group (e.g., methyl) or a hydrogen atom; $R_3$ and $R_4$ each represent a substituted or unsubstituted alkyl group (e.g., methyl, ethyl, propyl, i-propyl, butyl, i-butyl, pentyl, hexyl, ethoxycarbonylmethyl or ethoxyethyl) or a substituted or unsubstituted aryl group (e.g., phenyl or m-tolyl), provided that at least either one of $R_3$ and $R_4$ is an aryl group (e.g., m-tolyl or p-tolyl) substituted with an alkyl group (e.g., methyl or ethyl) or an alkyl group (e.g., methylbenzyl) substituted with an alkyl-substituted aryl group (e.g., methyl-substituted phenyl).

The post-chelating dye represented by Formula 1 is characterized by having at least one alkyl group (preferably methyl) substituted to an aromatic hydrocarbon ring, whereby the problem which those known similar dyes have can be surprisingly effectively solved.

The following are examples of the dye represented by Formula 1 (hereinafter referred to as the dye of the invention), but the invention is not limited thereto.

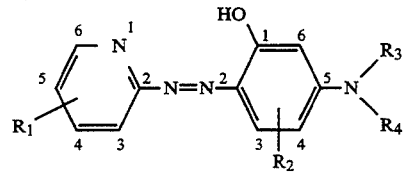

| Compound | $R_1$ | $R_2$ | $R_3$ | $R_4$ |
|---|---|---|---|---|
| M-1 | 5-Br | H | $C_2H_5$ | m-$CH_3$—$C_6H_5$ |
| M-2 | 5-Cl | H | $C_2H_5$ | m-$CH_3$—$C_6H_5$ |
| M-3 | H | H | $C_4H_9$(i) | m-$CH_3$—$C_6H_4CH_2$ |
| M-4 | H | H | $C_2H_5$ | m-$CH_3$—$C_6H_5$ |
| M-5 | 5-Br | 4-$CH_3$ | $C_2H_5$ | m-$CH_3$—$C_6H_5$ |
| M-6 | 5-Br | H | $C_4H_9$ | m-$CH_3$—$C_6H_4CH_2$ |
| M-7 | 5-Br | H | $C_2H_5$ | p-$CH_3$—$C_6H_5$ |

-continued

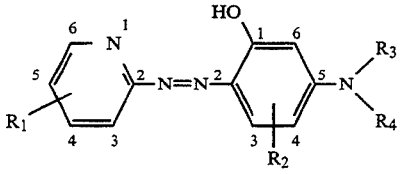

| Compound | $R_1$ | $R_2$ | $R_3$ | $R_4$ |
|---|---|---|---|---|
| M-8 | H | H | $C_2H_5$ | o-$CH_3$—$C_6H_5$ |
| M-9 | H | H | $CH_3$ | m-$CH_3$—$C_6H_4CH_2$ |
| M-10 | H | 4-$CH_3$ | $C_4H_9$ | m-$CH_3$—$C_6H_4CH_2$ |
| M-11 | H | H | $CH_3OCH_2CH_2$ | m-$CH_3$—$C_6H_4CH_2$ |
| M-12 | 5-Cl | H | $C_4H_9$ | m-$CH_3$—$C_6H_4CH_2$ |
| M-13 | 3-$CH_3$ | H | $C_2H_5$ | p-$CH_3$—$C_6H_4CH_2$ |
| M-14 | H | H | $C_2H_5$ | p-$CH_3$—$C_6H_5$ |
| M-15 | H | H | $CH_3$ | m-$CH_3$—$C_6H_5$ |

The thermal transfer recording material of the invention (hereinafter sometimes merely called the recording material) comprises support having thereon a thermal transfer layer containing the dye of the invention. The dye content of the thermal transfer layer is preferably 0.05 g to 10 g per $m^2$ of the support.

The formation of the thermal transfer layer can be carried out by coating/drying on a support an ink liquid prepared by dissolving or dispersing one or two or more kinds of the foregoing dye together with a binder into fine particulate form in a solvent. The dry thickness of the thermal transfer layer is preferably 0.1 to 10 μm.

The above-mentioned binder is preferably one of solvent-soluble polymers such as acryl resin, methacryl resin, polystyrene, polycarbonate, polysulfone, polyether-sulfone, polyvinyl butyral, polyvinyl acetal, nitrocellulose, ethylcellulose, and the like. The above binder may be used in the form of either an organic solvent solution or a latex dispersion of one or more kinds thereof. The using amount of the binder is preferably 0.1 to 20 g per $m^2$ of the support.

Useful examples of the solvent, particularly organic solvent, include alcohols such as ethanol and propanol, cellosolves such as methylcellosolve, aromatic solvents such as toluene and xylene, esters such as acetic acid esters, ketones such as acetone and methylethyl ketone, ethers such as tetrahydrofuran and dioxane, and the like.

As the support any material may be used as long as it is dimensionally stable and withstands heating by a thermal head for use in the thermal recording, but useful examples thereof include thin leaf papers such as condenser paper and glassine, and heat-resistant plastic films such as polyethylene terephthalate, polyamide and polycarbonate films. The thickness of the support is preferably 2 μm to 30 μm. It is preferable for the support to have thereon a subbing layer comprising a polymer selected for the purpose of improving the adhesion of it to a binder or preventing it from being dyed or subjected to dye transfer. Further, the support may have on its back (on the opposite side to the thermal transfer layer) a slipping layer for the purpose of preventing a thermal head from sticking thereto.

The recording material of the invention, in order that ordinary paper with no special image-receiving layer as described hereinafter can be used for image receiving, may have thereon a heat-meltable layer containing a heat-meltable compound as described in JP O.P.I. No. 106997/1984. As the heat-meltable compound there may be suitably used a colorless or white compound that is molten at a temperature of from 65° to 150° C., including waxes such as carnauba wax, beeswax and candelilla wax. The heat-meltable layer may contain a polymer such as polyvinylpyrrolidone, polyvinylbutyral, a polyester, vinyl acetate or the like.

In order to make the recording material of the invention applicable to full color image recording, it should have a structure comprising a support having the following three layers on the same side thereof: a magenta thermal transfer layer containing the magenta dye of the invention, a cyan thermal transfer layer containing a cyan image-forming heat-diffusible cyan dye, and a yellow thermal transfer layer containing a yellow image-forming heat-diffusible yellow dye. In addition, the recording material may, if necessary, be of a structure comprising four layers including an additional thermal transfer layer containing a black image forming material.

In the thermal transfer recording process of the invention, the foregoing recording material's thermal transfer layer superposed on an image-receiving layer with their surfaces in close contact with each other is subjected to heating according to imagewise information to effect the reaction between a metallic ion-containing compound (metal source) and the dye of the invention to thereby form an imagewise chelate dye on the image-receiving material. In the invention, since the dye represented by the foregoing Formula 1 is used, a high-density, stable and well color-reproduced image can be efficiently obtained. The above-mentioned metal source may be present either in the image-receiving material or in the heat-meltable layer provided on the thermal transfer layer.

To explain the thermal transfer recording process by making reference to the accompanying drawing, in FIG. 1(*a*), when a metal source is present in the image-receiving layer of image-receiving material 3 composed of support 1 and image-receiving layer 2, the foregoing dye in the thermal transfer layer of thermal transfer recording material 6 composed of support 4 and thermal transfer layer 5 is diffusedly transferred by heat from exothermic resistor 8 of, e.g., thermal head 7, to image-receiving material 3, and inside image-receiving layer 20 the dye reacts with the metal source to thereby form a chelate dye image.

In FIG. 1(*b*), where a metal source is present in the heat-meltable layer 9 provided on thermal transfer layer 5, the dye in the thermal transfer layer 5 of thermal transfer recording material 10 composed of support 4, thermal transfer layer 5 and heat-meltable layer 9 is diffusedly transferred by heat from exothermic resistor 8 of thermal head 7 to the heat-meltable layer 9, wherein the transferred dye reacts with the metal source to form a chelate dye, and then the heat-meltable layer containing the chelate dye is transferred by cohesive failure or by interfacial peeling onto image-receiving material 3, whereby an image is formed.

As the metal source there are inorganic or organic salts and complexes of metallic ions; of these the preferred are organic acid's salts and complexes of metals. Examples of the metal include monovalent and polyvalent metals belonging to Groups I to VIII of the Periodic Table of the Elements; among them the preferred are Al, Co, Cr, Cu, Fe, Mg, Mn, Mo, Ni, Sn, Ti and Zn, and the most preferred are Ni, Cu, Cr, Co and Zn.

Examples of the metal source include fatty acid salts such as acetic acid salts and stearic acid salts of or aromatic acid salts such as salicylic acid salts of $Ni^{2+}$, $Cu^{2+}$, $Cr^{2+}$, $Co^{2+}$ and $Zn^{2+}$. Also, complexes represented by the following Formula may be suitably used.

$$[M(Q_1)_p(Q_2)_q(Q_3)_r]^{9+}.n(Y^-)$$

wherein M is a metallic ion such as $Ni^{+2}$, $Cu^{2+}$, $Cr^{2+}$, $Co^{2+}$ or $Zn^{2+}$; $Q_1$, $Q_2$ and $Q_3$ are coordination compounds capable of coordinate-bonding with a metallic ion represented by M and may be either the same as or different from one another, wherein the coordination compound may be selected from among the coordination compounds described in, e.g., the 'Chelate Chemistry' (5) (Nanko-do); $Y^-$ represents an organic anion such as tetraphenyl boron anion or an alkylbenzenesulfonic anion; p represents an integer of 1, 2 or 3, q is an integer of 0, 1 or 2, and r is an integer of 1 or 2, which integers are determined according to whether the complex of the foregoing formula is of tetradentate ligand or hexadentate ligand or according to the number of ligands of $Q_1$, $Q_2$ and $Q_3$; and n is an integer of 1 or 2.

The adding amount of the metal source to the image-receiving material or heat-meltable layer is preferably 0.5 to 20 g/m$^2$ and more preferably 1 to 15 g/m$^2$.

The aforementioned image-receiving material used in the invention is of a composition comprising a support made of paper, plastic film or paper-plastic film complex, having thereon an image-receiving polymer layer made of one or more kinds of polymer resins such as polyesters, polyvinyl chloride, polyvinyl chloride-vinyl acetate copolymer, polyvinylbutyral, polyvinylpyrrolidone, polycarbonates and the like. The image-receiving material may have a protective layer on its image-receiving layer in order to prevent it from sticking to others. Further, for the purpose of adhesion, heat insulation or cushion effect there may be provided an intermediate layer between the support and the image-receiving layer. The above support itself may, in some cases, function as an image-receiving material.

EXAMPLES

The invention is illustrated in further detail by the following examples, but the invention is not restricted by the examples.

Example 1

Preparation of Ink

The following materials were sufficiently mixed to thereby obtain a uniform ink solution containing the dye of the invention. The dye had a good solubility and excellent aptitude for the ink preparation.

| | |
|---|---|
| Dye M-1 | 3.5 g |
| Polyvinylbutyral resin, BL-1, produced by Sekisui Chemical Ind. Co. | 6.5 g |
| Methyl-ethyl ketone | 200 ml |

Preparation of a Recording Material

The above ink was coated on a polyethylene terephthalate base of 4.5 μm in thickness by using a wire bar, and then dried, so as to have a dry coating weight of 0.8 g/m$^2$ to thus form a thermal transfer layer on the polyethylene terephthalate film, whereby Recording Material-1 was prepared.

The above polyethylene terephthalate base has on its reverse side a nitrocellulose layer containing a silicon-modified unrethane resin-SP-2105, produced by Dainichiseika, as an antisticking layer.

Preparation of an Image-receiving Material

A paper support having its both sides laminated with polyethylene, one side of which contains a white pigment $TiO_2$ and and a blue-tinting agent, was used to coat thereon a polyvinyl chloride resin containing an ester-modified silicone and the following metal source so that the resin has a coating weight of 5 g/m (the ester-modified silicone and metal source have coating weights of 0.15 g/m$^2$ and 3.5 g/m$^2$, respectively), whereby an image-receiving material was obtained.

Metal source:

$$[Ni^{2+}(NH_2CH_2CONH_2)_3]2[(C_6H_5)_4B]^-$$

Thermal Transfer Recording

The above recording material and the image-receiving material were superposed with their surfaces in close contact with each other, and a thermal head was applied to the back of the recording material to perform an image recording operation under the following conditions, whereby a magenta image having an excellent gradation was obtained.

Recording conditions

Main scanning/subscanning recording density: 8 dots/mm

Power for recording: 0.6 W/dot

Heating time: Adjusted stepwise between 20 msec to 0.2 msec.

The maximum density and light fastness of the obtained magenta image, the preservability of the recording material (ink sheet), and the dye's aptitude for ink preparation were evaluated as follows:

Maximum Density

The maximum reflection density of the image (usually at a section of the maximum heating time) was measured.

Fastness to Light

A xenon fade-o-meter was used to expose the image over a period of continued 72 hours, and the fastness to light of the image was evaluated by the following fourmula:

$$(D/D_0)\times 100$$

wherein $D_0$ represents the density before the exposure, and D is the density after the exposure.

Preservability of Ink Sheet

The ink surface of the ink sheet was contacted with the backing side (antisticking plane) of the same sheet, and was allowed to stand for three days at 55° C. After that, the degree of the dye's transfer onto the antisticking layer was visually examined. The preservability of the ink sheet was evaluated by classifying it into the following three ranks:

A: Almost no transfer of the dye to the backing side was found.

B: Transfer of the dye was found.

C: Conspicuous transfer of the dye was found.

Aptitude for Ink Preparation

The solubility of the dye at the time of ink preparation was evaluated by classifying it into the following two ranks.

In the above ink preparation, a: the dye was completely dissolved.

b: the dye was not completely dissolved.

Examples 2 to 8

Seven different recording material samples were prepared in the same manner as in Example 1 except that the dye M-1 of Example 1 was replaced by dyes M-2, M-3, M-5, M-6, M-7, M-10 and M-11. The prepared samples were used to make image recordings in the same manner as in Example 1. As a result, every sample provided a magenta image having an excellent gradation. These images and ink sheets were evaluated in the same way as in Example 1.

Comparative Examples 1, 2 and 3

Three different comparative recording material samples were prepared in the same manner as in Example 1 except that the dye of Example 1 was replaced by the following comparative Dyes A, B and C, and the prepared samples were used to make image recordings under the same recording conditions as the above. The obtained images and ink sheets were evaluated in the same manner as in Example 1. The results are as shown below:

Comparative compound-A

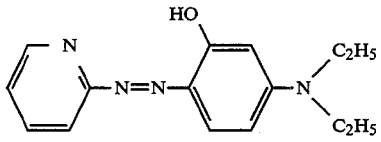

Comparative compound-B

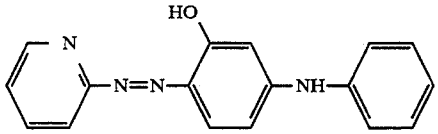

Comparative compound-C

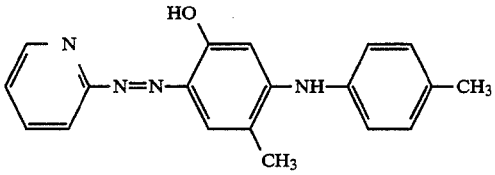

| Recording material | Dye | Dmax | Light fastness (%) | Sheet preserv-ability | Aptitude for ink preparation |
|---|---|---|---|---|---|
| Example 1 | M-1 | 2.23 | 95 | A | a |
| Example 2 | M-2 | 2.18 | 94 | A | a |
| Example 3 | M-3 | 2.12 | 97 | A | a |
| Example 4 | M-5 | 2.16 | 93 | A | a |
| Example 5 | M-6 | 2.21 | 94 | A | a |
| Example 6 | M-7 | 2.19 | 95 | A | a |
| Example 7 | M-10 | 2.15 | 93 | A | a |
| Example 8 | M-11 | 2.10 | 96 | A | a |
| Comp. Ex. 1 | Comp. A | 2.26 | 89 | C | a |
| Comp. Ex. 2 | Comp. B | 1.98 | 83 | B | c |
| Comp. Ex. 3 | Comp. C | 1.89 | 82 | B | c |

As is apparent from the above results, the dye of the invention is excellent in the solubility as well as in the aptitude for ink preparation, and the recording material, in which the dye of the invention is used, has a satisfactory preservability.

In addition, high-density magenta dye images having excellent fixability can be obtained from the recording material of the invention.

Example 9

On the polyethylene terephthalate film that was used as the support in Example 1 a thermal transfer layer containing a yellow image-forming Dye Y-1 (0.4 g/m$^2$), a thermal transfer layer containing the magenta Dye M-1 of the invention (0.35 g/m$^2$) and a thermal transfer layer containing a cyan image-forming Dye C-1 (0.4 g/m$^2$) were coated in the described order, whereby a recording material Sample 9 was prepared, wherein the binder for each thermal transfer layer was the same as in Example 1 (binder's coating weight for each layer: 0.4 g/m$^2$).

Y-1

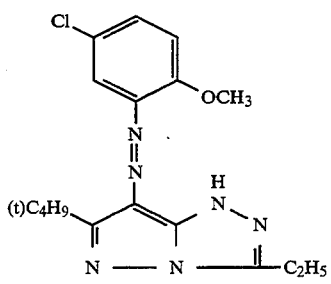

C-1

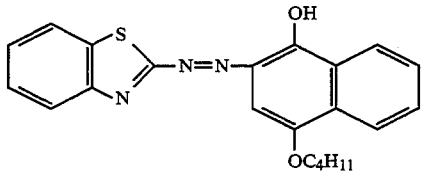

Subsequently, the above Sample 9 and the same image-receiving material as in Example 1 were used to make a full color image by using a full color printer CP3000, manufactured by Nikon Co. As a result, a full color image showing an excellent color reproduction was obtained. The obtained image was excellent in the stability (fixability and resistance to light).

Example 10

One hundred milliliters of an aqueous solution containing 5 g of p-toluamido ball mill dispersion, 7 g of polyvinylpyrrolidone, 3 g of gelatin and 0.3 g of hardener H-1 were coated so as to have the p-toluamido's coating weight of 0.5 g/m$^2$ as an intermediate layer on the recording material Sample 9 of Example 9. On the intermediate layer was further formed a heat-meltable layer by hot-melt coating of carnauba wax (2.0 g/m$^2$) containing the metal source shown in Example 1 (1.0 g/m$^2$), UV absorbent UV-1 (0.1 g/m$^2$), antioxidation agent AO-1 (0.1 g/m$^2$) and ethylene-vinyl acetate copolymer (vinyl acetate content: 20/%, coating weight:

0.2 g/m$^2$), whereby a recording material Sample 10 was obtained.

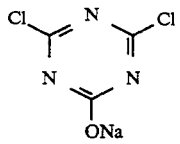

H-1

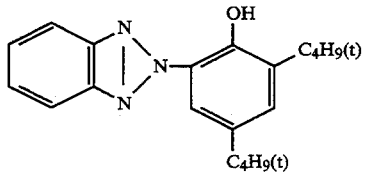

UV-1

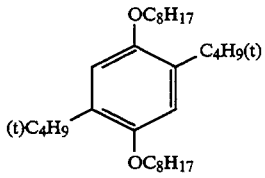

AO-1

The recording material Sample 10 and an image-receiving material were used to make full color image recording by use of the full color printer in the same manner as in Example 9, wherein the image-receiving material was an ordinary white paper.

The obtained full color image was excellent in the image stability as well as in the color reproduction and gradation.

What is claimed is:

1. A thermal transfer recording material comprising a support having thereon a thermal transfer layer containing a dye represented by the following formula (1)

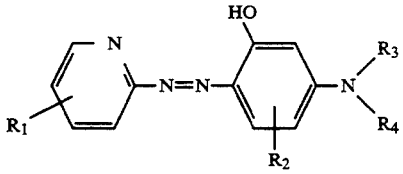

(1)

wherein $R_1$ is an alkyl group, a halogen atom or a hydrogen atom; $R_2$ is an alkyl group or a hydrogen atom; $R_3$ and $R_4$ each represent an alkyl or aryl group, provided at least either one of $R_3$ and $R_4$ is an aryl group substituted with an alkyl group or an alkyl group substituted with an alkyl-substituted aryl group.

2. The thermal recording material of claim 1, wherein said dye is contained in an amount of 0.05 to 20 g per m$^2$ of the support.

3. A thermal transfer recording process comprising superposing an image-receiving material upon a thermal transfer recording material comprising a support having thereon a thermal transfer layer containing a dye represented by the following formula (1)

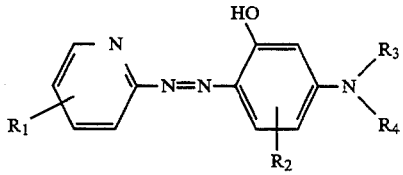

(1)

wherein $R_1$ is an alkyl group, a halogen atom or a hydrogen atom; $R_2$ is an alkyl group or a hydrogen atom; $R_3$ and $R_4$ each represent an alkyl or aryl group, provided at least either one of $R_3$ and $R_4$ is an aryl group substituted with an alkyl group or an alkyl group substituted with an alkyl-substituted aryl group; and heating the thermal transfer recording material to effect the reaction of the dye with a metallic ion-containing compound contained in the image-receiving material or in a layer of the thermal transfer recording material which is provided on the thermal transfer layer to thereby form a chelate dye image, wherein said reaction occurs by transfer of the dye from the thermal transfer layer to the metallic ion-containing compound.

4. The thermal recording process of claim 3, wherein said metallic ion-containing compound is contained in the image-receiving material or in a heat-meltable layer provided on the thermal transfer layer.

5. The thermal recording process of claim 3, wherein said metallic ion is selected from $Ni^{+2}$, $Cu^{+2}$, $Cr^{+2}$, $Co^{+2}$ and $Zn^{+2}$.

6. The thermal recording process of claim 4, wherein said metallic ion-containing compound is contained in an amount of 0.5 to 20 g per m$^2$ of the image-receiving material or the heat-meltable layer.

7. The thermal recording process of claim 3, wherein said image-receiving material comprises a support having thereon an image-receiving layer comprising one or more a polymer resins selected from a polyester, polyvinyl chloride, polyvinyl chloride-vinylacetate copolymer, polyvinylbutyral polyvinylpyrrolidone and polycarbonate.

* * * * *

UNITED STATES PATENT AND TRADEMARK OFFICE

CERTIFICATE OF CORRECTION

PATENT NO. : 5,432,144

DATED : July 11, 1995

INVENTOR(S) : Tawara KOMAMURA et al.

It is certified that error appears in the above-indentified patent and that said Letters Patent is hereby corrected as shown below:

Abstract, Title page, line 2, "recordimg" should read --recording--.

Claim 7, column 10, line 49, delete "a" (both occurrences).

Signed and Sealed this

Twenty-first Day of May, 1996

Bruce Lehman

*Attest:*

BRUCE LEHMAN

*Attesting Officer*

*Commissioner of Patents and Trademarks*